United States Patent [19]

Federico et al.

[11] 4,163,143

[45] Jul. 31, 1979

[54] HAIRDRESSING DEVICE

[76] Inventors: Joseph J. Federico, 432 Avery Pla., Bellevue, Nebr. 68005; William L. Gass, 2205 S. 86th St., Omaha, Nebr. 68124

[21] Appl. No.: 923,691

[22] Filed: Jul. 11, 1978

Related U.S. Application Data

[63] Continuation-in-part of Ser. No. 875,171, Feb. 6, 1978, abandoned.

[51] Int. Cl.[2] ..... H05B 1/00; A45D 1/18

[52] U.S. Cl. ..... 219/225; 132/32 R; 132/37 R; 132/118; 132/137; 132/142; 132/145; 132/150; 219/230

[58] Field of Search ..... 219/221-225, 219/230; 132/7, 9, 11 R, 112, 117, 118, 122-124, 126-127, 137, 142, 144, 145, 148, 150, 31 R, 31 A, 32 R, 32 A, 32 B, 33 R, 33 A, 33 F, 33 G, 37 R, 37 A, 38 R

[56] References Cited

U.S. PATENT DOCUMENTS

| | | | |
|---|---|---|---|
| 1,471,527 | 10/1923 | Proctor | 132/137 |
| 1,605,540 | 11/1926 | Gibney | 32/127 |
| 2,935,423 | 1/1976 | Pucci | 219/225 |
| 3,224,454 | 12/1965 | Quinio et al. | 132/33 R |
| 3,516,420 | 6/1970 | Porter | 219/225 X |

FOREIGN PATENT DOCUMENTS

| | | | |
|---|---|---|---|
| 452728 | 5/1969 | Switzerland | 219/225 |

*Primary Examiner*—A. Bartis

*Attorney, Agent, or Firm*—Cushman, Darby & Cushman

[57] ABSTRACT

An improved hair dressing device of the curling iron type having a heatable barrel is provided, along a longitudinal segment thereof, with a plurality of radially projecting hair combing teeth having substantially pointed ends. A hair-confining member, generally coextensive with and overlying the barrel segment in operative position, is pivotally mounted to the barrel, adjacent its rearward end for movement between the operative position and a non-operative position away from the barrel. Stop means are associated with the member for maintaining the same in spaced relation to the barrel and to the ends of the teeth in the operative position so as to essentially limit and minimize clamping pressure on hair confined between the member and the barrel to allow the hair to slide therebetween as the barrel is rotated during use, with a minimum possibility of hair being caught between the member and the ends of the teeth.

8 Claims, 6 Drawing Figures

HAIRDRESSING DEVICE

REFERENCE TO PARENT APPLICATION

This application is a continuation-in-part of our copending application Ser. No. 875,171, filed February 6, 1978 now abandoned.

BACKGROUND OF THE INVENTION

This invention relates to an improved hair dressing device of the type known as a curling iron. Conventional curling irons include a heatable cylindrical barrel and a clamp type hair-confining member which, in an operative position, overlies a longitudinal segment of the barrel and is pivotally secured to the latter for movement between the operative position and a non-operative position away from the barrel. Curling irons of this type designed for personal or home use usually have a spring arranged to urge the clamp against the barrel, while professional models usually lack the spring and the clamp is manipulated to and from operative position entirely by the fingers of the hair dresser. Conventional curling irons of this type, while adapted to curl hair, possess disadvantages. In operation of a conventional curling iron, a lock of hair is clamped, midway of its length, between the barrel of the iron and the clamp. The iron then usually is twirled or rotated on its axis to roll the lock of hair thereabout into close contact with the heated barrel, and the exterior of the clamp, to impart a curl to the lock. In this process it is desirable to pull the iron away from the scalp so that the lock wrapped about the iron is slowly released. To do so requires successive releases of the clamp, by manual manipulation, to enable the iron to be pulled free of the lock. In this process the end of the lock frequently is not wrapped appreciably about the iron and so is not curled. In some instances the end of the lock may actually be turned back upon the curl and develop a crimp therein which can be removed only by wetting and drying the hair lock.

Additionally, a lock of hair frequently does not have all the hairs therein arranged in a generally parallel or combed relation and by the heating action of the iron this relation persists in the curled lock with a resulting unesthetic or disarrayed appearance.

Improvements have been made in curling irons to overcome the last mentioned disadvantage, i.e. to attempt to comb the hair lock while it is being curled. For example, the U.S. Pat. No. 3,935,423 to Pucci, No. 3,935,423, Jan. 27, 1976, discloses an otherwise conventional curling iron, of the professional type, which has a longitudinal section of the heatable barrel equipped with several longitudinal rows of combing teeth. A longitudinal slot is provided in the hair clamping member through which one row of the teeth project when the clamping member is in operative position to press hair against the barrel. While this arrangement provides for the combing of a hair lock during a curling operation, the abovementioned disadvantages which require successive releases of the clamping member during a combing operation are sill obtained. In fact, this disadvantage is accentuated because the hair tends to be caught or entangled between the clamping member, the teeth extending through the slot, and the barrel, to such an extent that effective manipulation of the iron is rather difficult.

SUMMARY OF THE INVENTION

It is, therefore, an object of this invention to provide an improved hair dressing device of the curling iron type which greatly simplifies manual manipulation thereof during a hair curling operation and which effectively curls the entire length of a lock of hair without leaving an uncurled end or an end which has an undesirable crimp therein.

It is another object of this invention to provide an improved hair dressing device which will accomplish the foregoing object and also will effectively comb a lock of hair being curled.

It is another object of this invention to provide an improved hair dressing device which will accomplish the foregoing objects simply and inexpensively.

Other objects and the entire scope of the present invention will become apparent from the following detailed description and by reference to the accompanying drawings. It should be understood, however, that the detailed description and specific examples, while indicating preferred embodiments of the invention, are given by way of illustration only, since various changes and modifications within the spirit and scope of the invention will become apparent as the description herein progresses.

According to the invention there is provided a curling iron having a conventional heatable cylindrical body having a hair-confining member pivotally secured thereto for movement between an operative position closely overlying a longitudinal segment of the barrel and an inoperative position away from the barrel. A plurality of pointed hair-combing teeth project generally radially from the barrel segment, and stop means are provided for maintaining the hair-confining member in predetermined spaced relation to the barrel and to the ends of the teeth in the aforesaid operative position, so as to minimize and limit clamping pressure on hair confined between the member and the barrel.

DETAILED DESCRIPTION OF THE INVENTION

Figures 1, 2, 6:
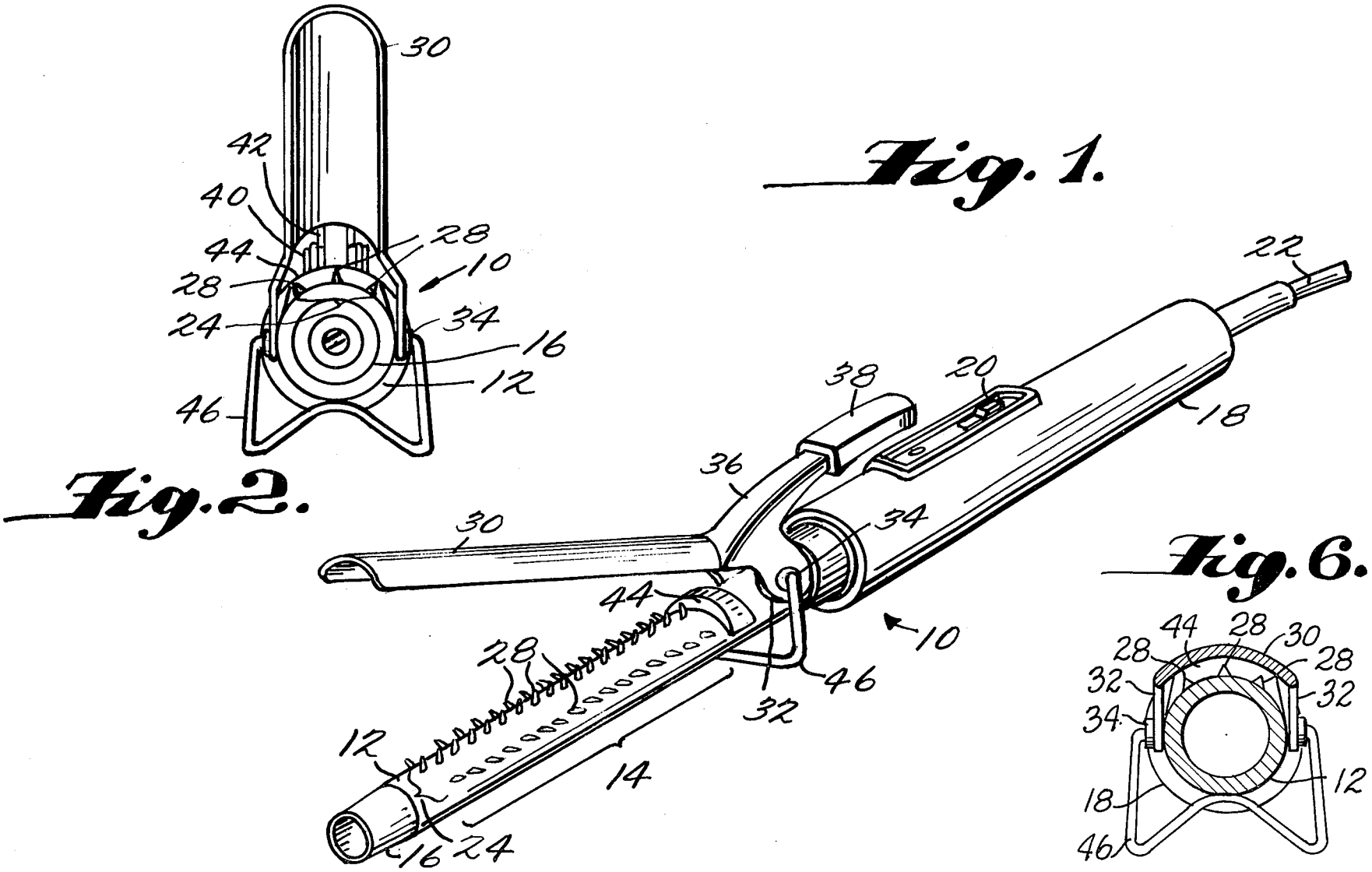
FIG. 1 is a perspective view of a hair-dressing device embodying this invention showing the hair-confining member in inoperative position.
FIG. 2 is an end view of the device shown in FIG. 1.
FIG. 6 is a cross-sectional view taken substantially on line 6—6 of FIG. 5.
Figure 3:
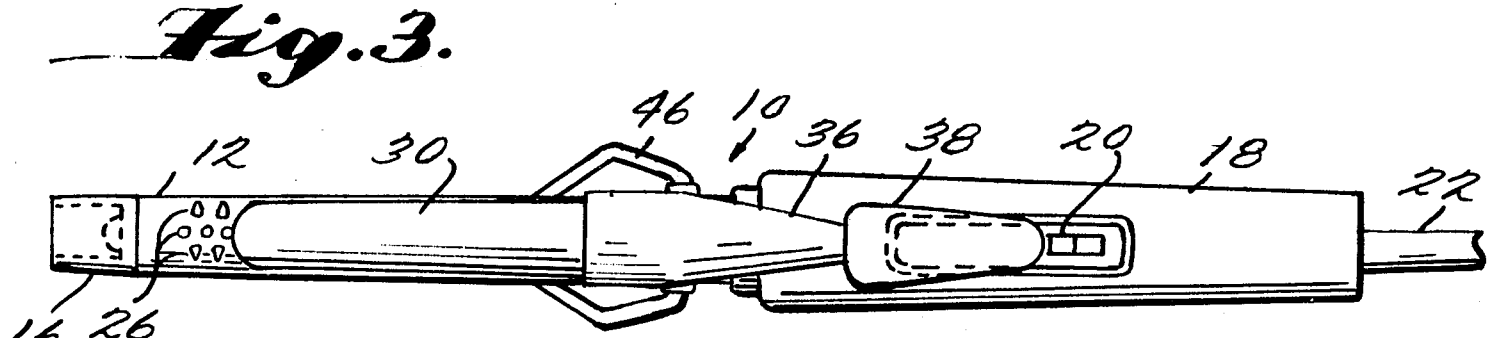
FIG. 3 is a plan view of the device shown in FIG. 1.

Referring now to the drawings, there is shown an improved hair-dressing device 10 of the type known as a curling iron which has a conventional heatable barrel 12, generally cylindrical in transverse section and of a diameter generally the same as that of a curl to be made. The diameter of the barrel 12 can, of course, be varied depending upon the size of the curl desired. In a preferred embodiment, the barrel may be of the order of three-quarters of an inch in diameter and with an effective longitudinal operative section 14 of the order of about four inches. The barrel 12 preferably is made of metal, e.g. steel, brass or aluminum, and conventionally is desirably provided with an antistick coating of Teflon or the like. The barrel 12 may be heated conventionally to effective hair-curling temperature, e.g. 160° F., by internal heating means, such as thermostatically controlled electrical resistance elements (not shown). The forward end of the barrel 12 may be closed by a plug 16 of thermally insulative material, while secured to the rearward end is an operating handle 18 of thermally insulating material which may have, on one side thereof, a conventional slide switch 20 for controlling electric current supplied to the interior electric resistance elements through a conventional electric cord 22 projecting from the rearward end of the handle 18.

Disposed along a longitudinal segment 24 of the operative section 14 of the barrel 12 are a plurality of rows 26 of equally spaced pointed hair-combing teeth 28, the rows being here shown as three in number spaced equally from each other circumferentially of the segment 24. The circumferential extent of the longitudinal barrel segment 24 may be of the order of somewhat less than 90° with substantially the same angular spacing between the two outer rows 26 of teeth 28. The teeth 28 in each row 26 may be staggered longitudinally with respect to adjacent rows, as shown. In an operative embodiment it has been found that teeth 28 of the order of one-sixteenth of an inch in length are effective for combing a lock of hair, and desirably have their ends smoothly rounded. In the embodiment shown there are about seventeen teeth 28 in each outer row 26 and about eighteen teeth in each inner row. It will be realized, however, that the number of teeth 28 in each row 26, the number of rows, the spacing between rows, and the spacing between and height of the teeth in each row can be varied for most effective operation of the curling iron 10. Preferably, the teeth 28, like the operative section 14 of the barrel 12, are coated with an antistick material, such as Teflon. Also, the teeth 28 preferably are of the same material as the barrel 12 and secured in good heat exchange relation therewith so as to be heated thereby.

Figure 5:
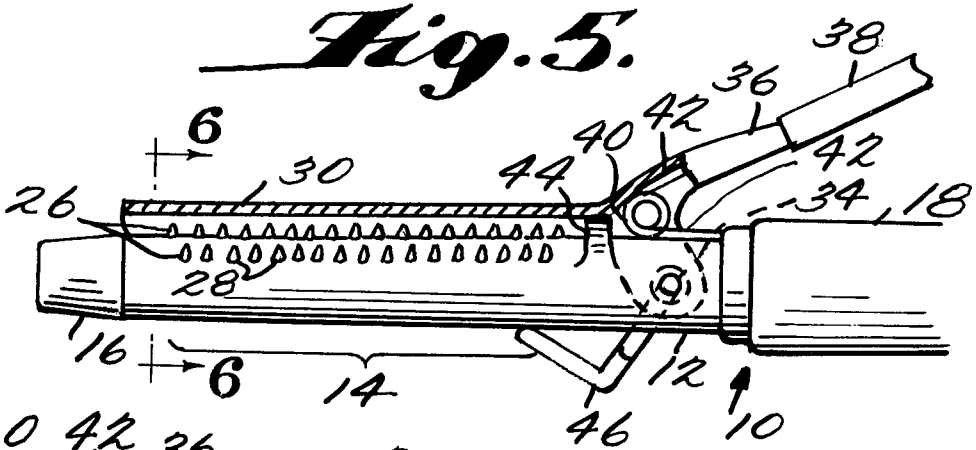
FIG. 5 is a fragmentary view, partly in vertical section, corresponding to FIG. 4 but showing the haircon-fining member in operative position.

A hair-confining member 30, generally arcuate in transverse section and coextensive both circumferentially and longitudinally with the longitudinal segment 24 of the barrel 12, is designed to overlie the latter in a hair-confining operative position as shown in FIG. 5. The member 30 is provided, at its rearward end, with spaced ears 32 pivotally secured to the rearward portion of the barrel 12 by a transverse pivot pin 34 for movement between the aforesaid operative position and a position away from the barrel as shown in FIGS. 1–4. In the embodiment shown the hair-confining member 30 is provided with an upwardly and rearwardly inclined extension 36 provided at its end with a thumb rest 38 for engagement by an operator to move the member from its operative to its non-operative position. Preferably, a coil torsion spring 40 is interposed between and has its two arms 42 engaged with the extension 36 and the barrel 12, respectively, to urge the hair-confining member 30 to its operative position shown in FIG. 5.

In its operative position the hair-confining member 30 is maintained in spaced relation both with the barrel 12 and the ends of the teeth 28, as shown in FIG. 5, the spacing between the ends of the teeth and the member being of the order of one-sixteenth of an inch, although such spacing may be more or less to encompass practical effective variations. The aforementioned spaced relation, in operative position of the member 30, is maintained by stop means, here shown as a ring segment 44 secured to the barrel 12 between the rearward end of the tooth rows 26 and the ears 32. While the stop means 44 may be secured to the member 30 rather than to the barrel 12, it has been found in actual practice that the latter arrangement is preferable.

Figure 4:
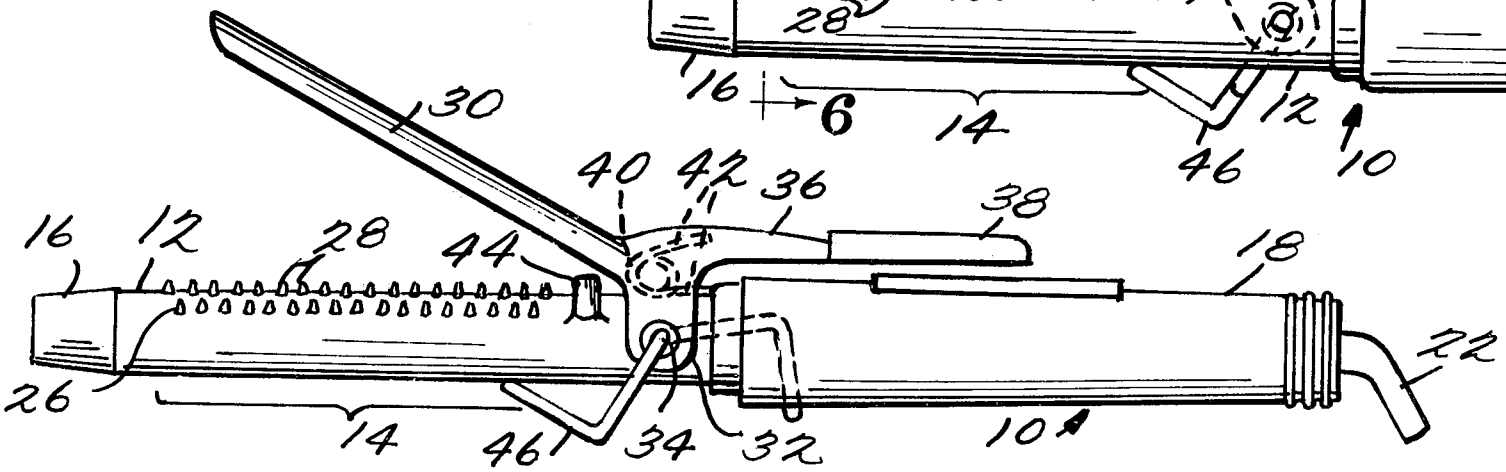
FIG. 4 is a side elevational view of the device shown in FIG. 1.

Optionally, the curling iron 10 may be provided with a wire stand or rest 46 attached to the ends of the pivot pin 34 and movable between the operative position shown in the drawings and the inoperative position shown in dotted lines in FIG. 4.

Instead of the extension 36 and thumb rest arrangement 38 shown for moving the member 30 between operative and inoperative positions, the iron 10 may be equipped with the professional hair dresser manipulative arrangement disclosed in the aforementioned Pucci patent for so moving the member 30. Such an arrangement involves an extension (not shown) of the member 30 on the opposite side of the handle 18 from the member, such extension being manipulated by the fingers of an operator.

In operation of the improved curling iron 10 the member 30 is moved to its inoperative position and a lock of hair to be curled is positioned between the barrel 12 and the member 30. The member 30 is then released so as to be moved by the spring 40 to its operative position and so confine the hair, generally midway of its length, between the member 30 and the barrel 12. In this connection, it will be seen that the ring segment stop 44 hinders placement of a hair lock on the rearward end of the barrel 12, which usually is not heated effectively to hair curling temperature and also closely adjacent the ears 32 and pivot pin 34 where a hair lock might become entangled. After appropriate confinement of the hair lock to be curled between the member 30 and the barrel 12, the iron 10 is simply rotated or twirled about its longitudinal axis by manipulation of the handle 18 by the operator, and in this process the hair lock to be curled is wound about the heated barrel and as a result has a curl effectively set therein. Because of the aforedescribed predetermined spacing between the member 30 and the barrel 12 and between the member and the ends of the teeth 28, when the barrel is rotated the hair lock slides with only small resistance between the member and the barrel so that only a gentle constant pull is exerted on the hair lock that imparts no discomfort to the person whose hair is being curled. This is in great contrast to conventional curling irons, heretofore described, which clamp the hair tightly between a clamping member and the barrel so that, unless the clamp is properly released, an uncomfortable tug is exerted on the hair. It also will be seen that the construction imparts a complete curl to the end of a hair lock so as not to leave undesirable straight ends or ends which have an undesirable backward kink therein.

Furthermore, rotation of the barrel 12 smoothly combs the lock of hair with the teeth 28 simultaneously with curling it, thus minimizing the necessity for extensive precurling brushing or combing operations.

It further will be seen that the improved iron 10 can be used for straightening undesirably curly or kinky hair. For this purpose a strand or lock of hair to be uncurled or unkinked is confined, near the scalp, between the member 30 and the barrel 12 and then the iron 10 simply pulled gently away from the scalp so that the hair will simply slip, while being combed and while being heated, between the barrel 12 and the member 30 so as to at least partially straighten a curly or kinky lock.

It thus will be seen that the objects of this invention have been fully and effectively accomplished. It will be realized, however, that the specific embodiments shown and described are susceptible of modification without departure from the principles of the invention. Hence, the invention encompasses all modifications within the spirit and scope of the following claims.

We claim:

1. A hair curling iron comprising:

generally cylindrical heatable barrel means adapted to have a lock of hair wrapped thereabout for curling the same, said barrel means having forward and rearward ends;

means for heating a longitudinal section of said barrel means to hair curling temperature;

a handle secured to said rearward end of said barrel means for manipulating said barrel means;

a plurality of substantially pointed hair-combing teeth secured to and projecting generally radially from said barrel means along a circumferential segment of said longitudinal section;

a hair-confining member having an operative portion generally arcuate in transverse section and generally coextensive with said barrel means segment, said portion being adapted, in operative position, to overlie said barrel means segment in generally parallel relation and confine hair therebetween;

means pivotally mounting said member to said iron adjacent said barrel means rearward end for movement between said operative position and a non-operative position away from said barrel means segment;

manually manipulable operating means secured to said member and extending generally along said handle for pivotally moving said member between said positions; and stop means independent of said teeth provided on one of said member and said barrel means for maintaining a predetermined spaced relation between said member and said barrel means and between said members and the ends of said teeth in said operative position of said member to minimize clamping pressure by said member on hair confined between said member and said barrel means.

2. The structure defined in claim 1 in which the stop means is secured to the barrel means adjacent the rearward end of the barrel means.

3. The structure defined in claim 2 in which the stop means comprises a circumferential ring segment for minimizing hair confinement rearwardly thereof.

4. The structure defined in claim 1 in which the operating means is on the same side of the barrel means as the member.

5. The structure defined in claim 4 including spring means associated with the member for urging the same to operative position.

6. The structure defined in claim 1 in which the teeth are arranged in rows longitudinally of the barrel means.

7. The structure defined in claim 1 in which the teeth are heatable by being in good heat exchange relation with the barrel means.

8. The structure defined in claim 1 in which both the barrel means and the teeth are of metal and secured together in good heat exchange relation.

* * * * *